US010845725B2

(12) United States Patent
Kidaka

(10) Patent No.: US 10,845,725 B2
(45) Date of Patent: Nov. 24, 2020

(54) IMAGE FORMING APPARATUS

(71) Applicant: CANON KABUSHIKI KAISHA, Tokyo (JP)

(72) Inventor: Hiroyuki Kidaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/504,071

(22) Filed: Jul. 5, 2019

(65) Prior Publication Data

US 2020/0026214 A1 Jan. 23, 2020

(30) Foreign Application Priority Data

Jul. 20, 2018 (JP) ..... 2018-137198

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS

2003/0219267 A1* 11/2003 Shim ..... G03G 15/0266 399/50
2006/0127107 A1* 6/2006 Kamisuwa ..... G03G 15/5037 399/26
2008/0187334 A1* 8/2008 Hano ..... G03G 15/0266 399/48
2011/0182618 A1* 7/2011 Kuruma ..... G03G 15/0233 399/111
2018/0143561 A1* 5/2018 Kitajima ..... G03G 15/02

FOREIGN PATENT DOCUMENTS

JP 2000-235299 A 8/2000
JP 2000-305342 A 11/2000
JP 2009-8828 A 1/2009

OTHER PUBLICATIONS

Machine Translation of JP 2009008828. Jan. 15, 2009. (Year: 2009).*

* cited by examiner

*Primary Examiner* — Carla J Therrien
(74) *Attorney, Agent, or Firm* — Venable LLP

(57) ABSTRACT

An image forming apparatus includes a photosensitive member unit, a charging member, an exposing unit, a developing unit, an information storage portion, and a setting portion. The information storage portion stores information on an attenuation amount of a surface potential of the photosensitive member by which the surface potential is attenuating until the photosensitive member rotates from a contact position of the photosensitive member to a development position of the photosensitive member. If the attenuation amount is a first attenuation amount, the setting portion sets an applying voltage to be applied to the charging member at the time of image formation to a first voltage. If the attenuation amount is a second attenuation amount greater than the first attenuation amount, the setting portion sets an applying voltage to be applied to the charging member at the time of image formation to a second voltage higher than the first voltage.

1 Claim, 9 Drawing Sheets

IMAGE FORMING APPARATUS

BACKGROUND OF THE INVENTION

Field of the Invention

The present invention relates to an image forming apparatus using electrophotographic technology, such as a printer, a copier, a facsimile machine, or a multifunction machine.

Description of the Related Art

In an image forming apparatus using an electrophotographic system, an electrostatic latent image is formed by an exposing unit on a photosensitive drum charged by a charging unit, and the electrostatic latent image is developed into a toner image at a development position by a developing unit disposed opposite to the electrostatic latent image. As a charging unit, a charging roller is used which generates less ozone as compared with a corona discharger and requires a low voltage to be applied for charging. The charging roller is in contact with the photosensitive drum at a contact position to form a nip. The photosensitive drum is charged by applying a DC voltage to the charging roller and generating a discharge in the vicinity of the nip (so-called DC charging system). The photosensitive drum is charged if the voltage applied to the charging roller (referred to as an applying voltage for convenience) is equal to or higher than a discharge start voltage. Generally, the relationship between the voltage applied to the charging roller and the surface potential of the photosensitive drum has a voltage-potential relationship of "inclination 1", in which when the voltage applied to the charging roller is raised by "1 V" with reference to the discharge start voltage, the surface potential of the photosensitive drum rises by "1 V". Therefore, in order to charge the photosensitive drum to a target potential, a voltage obtained by adding the target potential to the discharge start voltage is applied to the charging roller as an applying voltage.

However, in a case of an actual image forming apparatus, the relationship between the voltage applied to the charging roller and the surface potential of the photosensitive drum may not have the "inclination 1" relationship depending on the material of the charging roller. If so, even if the applying voltage obtained by adding the target potential to the discharge start voltage as described above is applied to the charging roller, the surface potential of the photosensitive drum at the development position is unlikely to be charged to an appropriate potential. In view of this point, hitherto, the relationship between the voltage applied to the charging roller and the surface potential of the photosensitive drum is stored in advance in a storage unit provided in the image forming apparatus body according to the material of the charging roller. Then, grooves having different depths according to the material are formed on the shaft of the charging roller, and by detecting the depths of the grooves, the relationship between the voltage applied to the charging roller and the surface potential of the photosensitive drum according to the material is read out from the storage unit and used. (Japanese Patent Application Laid-Open Publication No. 2000-235299).

Recently, in order to realize the long lifetime of the photosensitive drum in a DC charging system, the attenuation amount of the surface potential of the photosensitive drum is increased. The surface potential (dark potential) is attenuated until the charged photosensitive drum rotates from the contact position to the development position, but in a case where the attenuation amount of the surface potential (referred to as dark attenuation amount) is increased, the dark attenuation amount is likely to vary greatly among photosensitive drums. Therefore, hitherto, in a case where the photosensitive drum is replaced, the surface potential of the photosensitive drum may not be an appropriate potential at the development position due to the variation in the dark attenuation amount. If the surface potential of the photosensitive drum does not reach an appropriate potential at the development position, image defects such as image density fluctuation and scattering fog are likely to occur. Therefore, hitherto, there has been desired an apparatus capable of charging the surface potential properly by the charging roller even in a case where the attenuation amount of the surface potential of the photosensitive drum is different in the DC charging system.

SUMMARY OF THE INVENTION

According to one aspect of the present invention, an image forming apparatus includes a photosensitive member unit comprising a rotatable photosensitive member and being attachable to or detachable from the image forming apparatus, a charging member configured to contact the photosensitive member and charge a surface of the photosensitive member by applying only a DC voltage, an exposing unit configured to expose the charged surface of the photosensitive member to form an electrostatic latent image, a developing unit comprising a developer bearing member for bearing developer and configured to develop the electrostatic latent image formed on the photosensitive member, an information storage portion provided in the photosensitive member unit and configured to store information with respect to an attenuation amount of a surface potential of the photosensitive member by which the surface potential is attenuating until the photosensitive member rotates from a contact position of the photosensitive member to the charging member to a development position of the photosensitive member facing to the developer bearing member, and a setting portion configured to set a voltage to be applied to the charging member at a time of image formation before the image formation is started after the photosensitive member unit is attached to the image forming apparatus based on a current value flowing to the charging member in a case where a voltage of a preset voltage value is applied to the charging member, the preset voltage value, and the information with respect to the attenuation amount. If the attenuation amount is a first attenuation amount, the setting portion sets an applying voltage to be applied to the charging member at the time of image formation to a first voltage. If the attenuation amount is a second attenuation amount larger than the first attenuation amount, the setting portion sets an applying voltage to be applied to the charging member at the time of image formation to a second voltage larger than the first voltage.

Further features of the present invention will become apparent from the following description of exemplary embodiments with reference to the attached drawings.

DESCRIPTION OF THE EMBODIMENTS

Image Forming Apparatus

Figure 1:
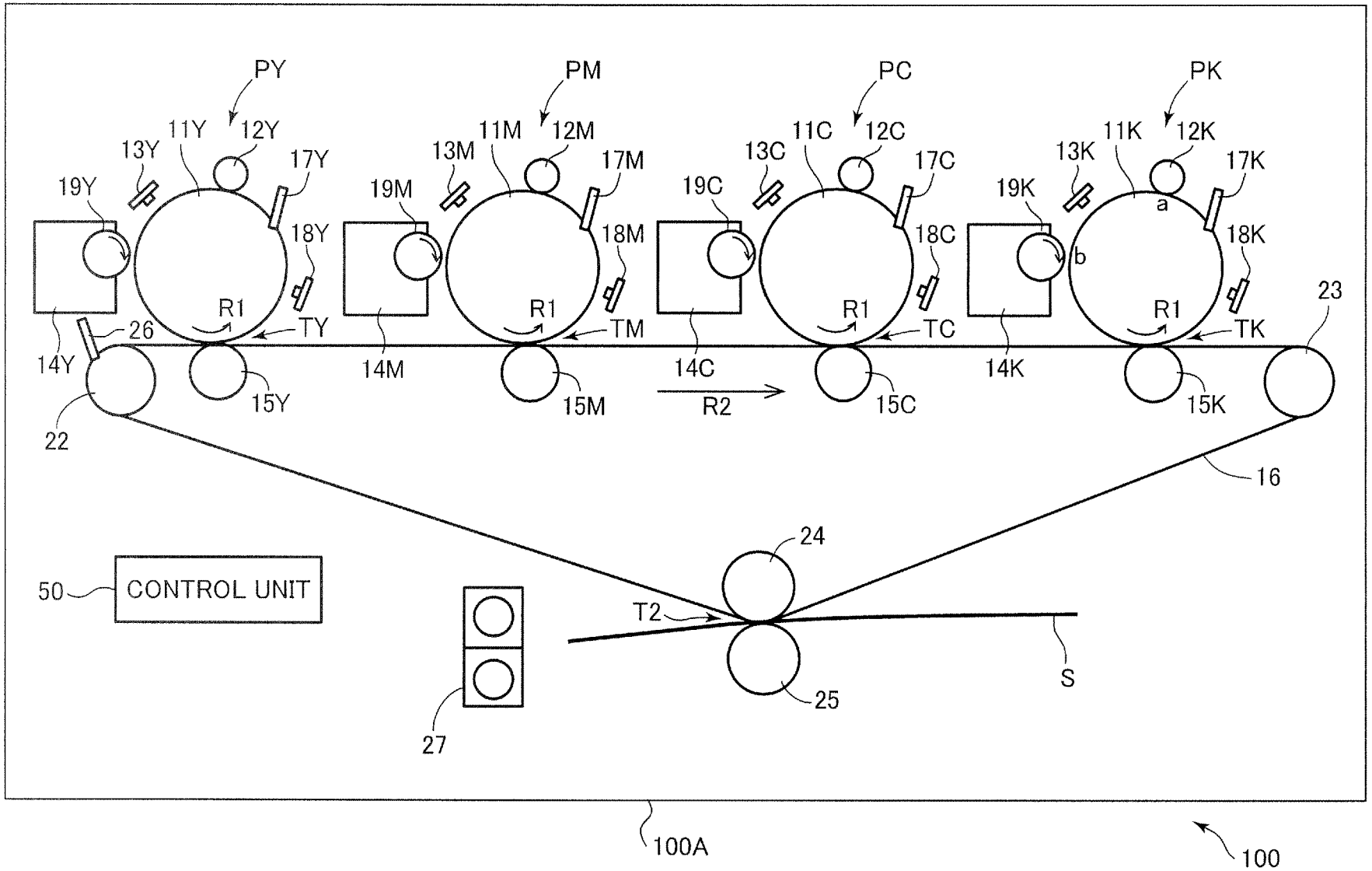
FIG. 1 is a schematic diagram showing a configuration of an image forming apparatus of the present embodiment.

An image forming apparatus of the present embodiment will be described. An image forming apparatus 100 shown in FIG. 1 is a full-color printer of a tandem-type intermediate transfer system including a plurality of yellow, magenta, cyan, and black image forming units PY, PM, PC, and PK along an intermediate transfer belt 16. In the image forming unit PY, a yellow toner image is formed on a photosensitive drum 11Y and is primarily transferred to the intermediate transfer belt 16. In the image forming unit PM, a magenta toner image is formed on a photosensitive drum 11M and is primarily transferred to the intermediate transfer belt 16 by being superimposed on the yellow toner image. In the image forming units PC and PK, a cyan toner image and a black toner image are formed on photosensitive drums 11C and 11K, respectively, and primarily transferred to the intermediate transfer belt 16 by being sequentially superimposed. The composite toner images of the respective colors primarily transferred to the intermediate transfer belt 16 are conveyed to a secondary transfer unit T2 and collectively secondarily transferred onto a recording material S (sheet material such as paper, OHP sheet, and the like).

The secondary transfer unit T2 is a toner image transfer nip portion on the recording material S formed by the pressure contact of a secondary transfer outer roller 25 on the intermediate transfer belt 16 extended around a secondary transfer inner roller 24. In the secondary transfer unit T2, a secondary transfer bias is applied to the secondary transfer outer roller 25 by a high voltage power source (not shown), whereby the toner image is secondarily transferred from the intermediate transfer belt 16 to the recording material S. The recording material S on which the composite toner image of each color is secondarily transferred at the secondary transfer unit T2 is conveyed to a fixing unit 27. The fixing unit 27 heats and presses the recording material S while conveying the recording material S, and fixes the toner image on the recording material S. The recording material S on which the toner image is fixed by the fixing unit 27 is discharged out of a machine body. The toner remaining on the intermediate transfer belt 16 after the secondary transfer is collected by a belt cleaning unit 26 rubbing the intermediate transfer belt 16.

The image forming units PY, PM, PC, and PK have substantially the same configuration as each other except that developing units 14Y, 14M, 14C, and 14K use different toner colors, yellow, magenta, cyan, and black. Therefore, hereinafter, the black image forming unit PK will be described as a representative.

In the image forming unit PK, a charging roller 12K, an exposing unit 13K, the developing unit 14K, a primary transfer roller 15K, a neutralizing and exposing unit 18K, and a cleaning blade 17K are disposed surrounding the photosensitive drum 11K. The photosensitive drum 11K as a photosensitive member is a cylindrical OPC photosensitive member in which an OPC organic photosemiconductor is applied as a photosensitive layer on the outer peripheral surface of an aluminum cylinder (substrate), for example, and a curable resin is used as a resin for a charge transport layer. The photosensitive drum 11K is rotatably provided in the direction of an arrow R1 in the drawing.

Figure 2:
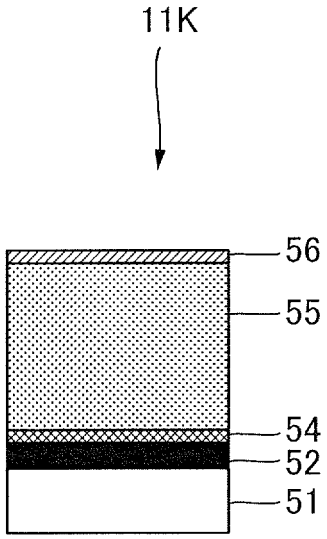
FIG. 2 is a cross-sectional diagram showing a structure of a photosensitive drum.

The configuration of the photosensitive drum 11K will be described with reference to FIG. 2. As shown in FIG. 2, in the photosensitive drum 11K, for example, an undercoat layer 52, OPC photosensitive layers (54 and 55), and a surface protection layer 56 are formed in order from the lower layer on a conductive substrate 51 made of aluminum and having conductivity. The undercoat layer 52 covers the conductive substrate 51 for improvement of the adhesion and coating of the OPC photosensitive layer, protection of the conductive substrate 51, covering of the defective portion of the conductive substrate 51, improvement of the charge injection from the conductive substrate 51, and protection of the OPC photosensitive layer against an electrical breakdown. The OPC photosensitive layer is formed by sequentially stacking a charge generation layer (CG layer) 54 containing a charge generation substance and a charge transport layer (CT layer) 55 containing a charge transport substance. It is preferable that the surface protection layer 56 for protecting the OPC photosensitive layer is formed on the OPC photosensitive layer. In the present embodiment, in order to realize the long lifetime of the photosensitive drum 11K in the DC charging system, the photosensitive drum 11K having a dark attenuation amount of 30 V or more is used. However, the OPC photosensitive layers (54, 55) may be formed with different film thicknesses for each photosensitive drum 11K, and even with a new photosensitive drum 11K, if the film thickness of the OPC photosensitive layer (particularly, the charge transport layer 55) is different, the above-described dark attenuation amount may vary.

Returning to FIG. 1, the charging roller 12K is in contact with the photosensitive drum 11K at a "contact position a" and is provided so as to be driven and rotated by the rotation of the photosensitive drum 11K. The charging roller 12K as a charging member generates a discharge with the photosensitive drum 11K by application of a DC voltage, and the surface of the photosensitive drum 11K is uniformly charged to a potential of a predetermined polarity (for example, a dark portion potential) at the "contact position a". The charging of the photosensitive drum 11K by the charging roller 12K is preferably performed such that a surface potential Vd at a "development position b" of the photosensitive drum 11K is, for example, approximately "700 V" (target potential), as described later. In a case where pinholes or the like occur on the surface of the photosensitive drum 11K, the charging roller 12K is preferably formed in a plurality of layer configurations having a resistance layer on the surface so that a charging failure of the horizontal streaks does not occur as a result of the surface potential drop of the charging roller 12K due to the voltage concentration on the pinholes.

The exposing unit 13K as an exposing unit generates a laser beam having a wavelength of 780 nm, for example, which is generated by turning on and off scanning line image data obtained by expanding a separated color image from a laser light emitting element and scans the laser beam with a rotating mirror to form an electrostatic latent image of the image on the charged photosensitive drum 11K. In this case, the surface potential of the photosensitive drum 11K on which the electrostatic latent image is written is a relatively light potential.

The developing unit 14K has a developing sleeve 19K which is an example of a developer bearing member. The developing unit 14K is disposed opposite to the photosensitive drum 11K and supplies a toner to the photosensitive drum 11K to develop the electrostatic latent image into a toner image when the electrostatic latent image formed on the photosensitive drum 11K reaches the opposite "development position b". The development position is the closest position between the photosensitive drum 11K and a developing sleeve 19K described later. In the developing unit 14K, a two-component developer including a toner (non-magnetic) of negative charging characteristics and a carrier having positive charging characteristics as a developer is circulated and conveyed while being stirred. The toner includes a binder resin such as a styrene resin or a polyester resin, a coloring agent such as carbon black, a dye, or a pigment, and, colored resin particles including other additives as necessary, and colored particles to which an external additive such as colloidal silica fine powder is externally added. As the carrier, for example, surface oxidized or unoxidized iron, metals such as nickel, cobalt, manganese, chromium, rare earths and alloys thereof, or oxide ferrites, and the like can be suitably used.

The primary transfer roller 15K is disposed opposite to the photosensitive drum 11K with the intermediate transfer belt 16 interposed therebetween and forms a primary transfer portion (nip) TK of the toner image between the photosensitive drum 11K and the intermediate transfer belt 16. A primary transfer power source (not shown) is connected to the primary transfer roller 15K, and a DC voltage (primary transfer voltage) opposite to the charge polarity of the toner is applied by the primary transfer power source, whereby the toner image on the photosensitive drum 11K is primarily transferred to the intermediate transfer belt 16. The intermediate transfer belt 16 is stretched and supported by being supported by a tension roller 22, a drive roller 23, and the secondary transfer inner roller 24 and is driven by the drive roller 23 and provided so as to be movable in a predetermined movement direction (direction of arrow R2 in the drawing).

The cleaning blade 17K is disposed on the upstream side of the charging roller 12K in the rotational direction of the photosensitive drum 11K and the downstream side of the primary transfer roller 15K in the rotational direction of the photosensitive drum 11K. The cleaning blade 17K is in contact with the photosensitive drum 11K at a contact portion, and mechanically scrapes and removes the primary transfer residual toner remaining on the photosensitive drum 11K after the primary transfer. In the present embodiment, the cleaning blade 17K made of polyurethane rubber is used.

The neutralizing and exposing unit 18K for neutralizing and exposing the surface of the photosensitive drum 11K is disposed on the upstream side of the cleaning blade 17K in the rotational direction of the photosensitive drum 11K and on the downstream side of the primary transfer roller 15K in the rotational direction of the photosensitive drum 11K. The neutralizing and exposing unit 18K applies laser light with intensity (neutralization amount) different from that of the exposing unit 13K and reduces the surface potential of the photosensitive drum 11K to a predetermined potential (for example, 100 V).

Control Unit

Figure 3:
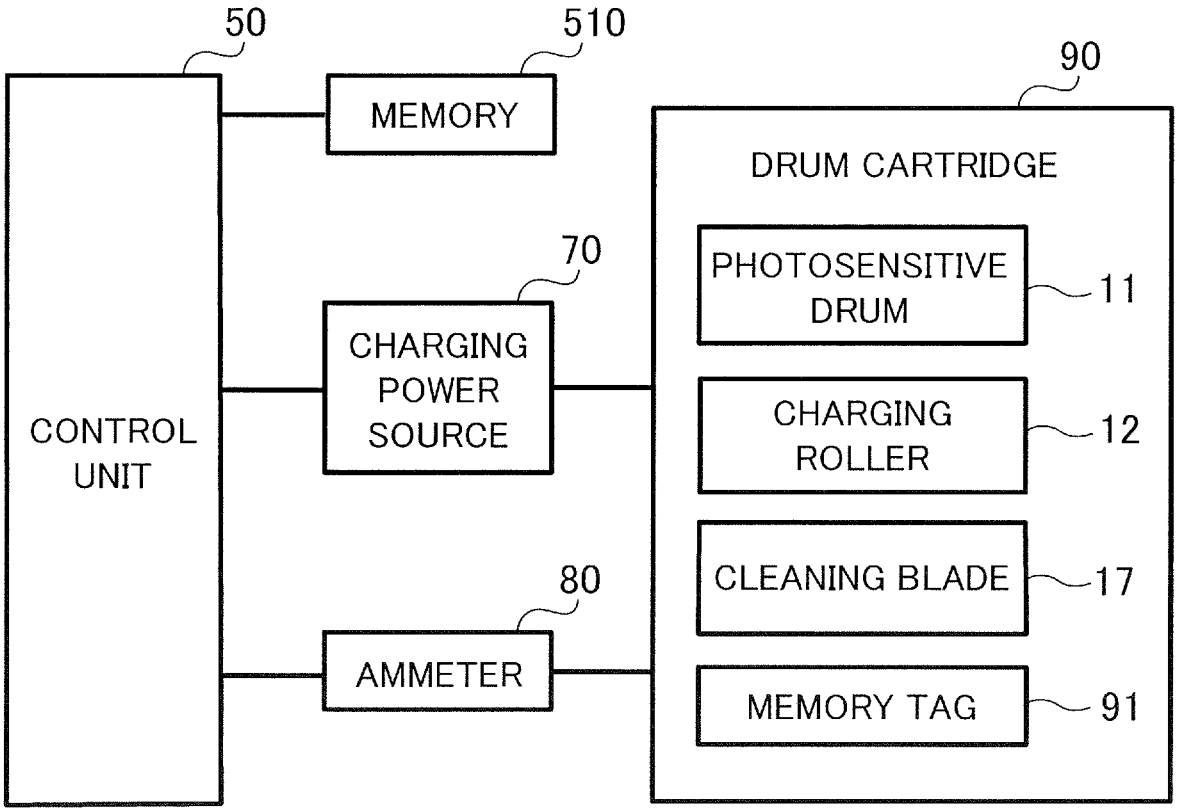
FIG. 3 is a control block diagram showing a control unit.

The image forming apparatus 100 includes a control unit 50 as a setting portion, and the control unit 50 is, for example, a central processing unit (CPU) that performs various controls and various settings of the image forming apparatus 100 such as an image forming operation. In order to describe the control unit 50, a block diagram of a charge control system for charging the photosensitive drum 11K is shown in FIG. 3. Although the control unit 50 can control the above-described units (see FIG. 1) in addition to the illustrated ones, the illustration and the description thereof are omitted here because the units are not the gist of the invention.

As shown in FIG. 3, a memory 510 is connected to the control unit 50. The memory 510 is a read only memory (ROM), a random access memory (RAM), a hard disk, or the like. The memory 510 stores, for example, various programs such as an image forming job and various data. The control unit 50 can operate the image forming apparatus 100 by executing various programs stored in the memory 510.

Here, the image forming job is a series of operations from the start to the completion of the image forming operation based on a print signal for forming an image on the recording material. That is, the image forming job is a series of operations after a preliminary operation (so-called, pre-rotation) required to form an image is started until a preliminary operation (so-called, post-rotation) required to complete the image formation is completed through the image forming process. Specifically, the image forming job refers to the time from pre-rotation (preparation operation before image formation) after receiving a print signal (reception of an image forming job) to post-rotation (operation after image formation) and includes an image formation period and a sheet interval.

The memory 510 may store work data and input data. The control unit 50 can refer to various data stored in the memory 510 based on various programs and the like. In a case of the present embodiment, the control unit 50 can store, for example, the "discharge start voltage" described later, the "inclination of surface potential" read from a memory tag 91 described later, and the like in the memory 510. Then, the control unit 50 sets an applying voltage Vc to be applied to a charging roller 12 by using the "inclination of surface potential" read from the memory tag 91 and the calculated "discharge start voltage". This will be described later.

In the case of this embodiment, a photosensitive drum 11 is combined with the charging roller 12 and a cleaning blade 17 or the like and is configured as a drum cartridge 90 as a photosensitive member unit which can be replaced with respect to an apparatus body 100A of the image forming apparatus 100. That is, the photosensitive drum 11, the charging roller 12, and the cleaning blade 17 are integrally formed as the drum cartridge 90. The control unit 50 can control the voltage applied to the charging roller 12 by a charging power source 70 with respect to the drum cartridge 90. Then, the control unit 50 obtains a current value from an ammeter 80 as a current detection unit that detects the current flowing from the charging roller 12 to the photosensitive drum 11 according to the application of the voltage to the charging roller 12 by the charging power source 70. In the case of the present embodiment, the charging power source 70 can apply a DC voltage to the charging roller 12.

The DC voltage referred to here is not limited to one having only a DC component and may include one having a DC component and a slight alternating current component (for example, about several percent with respect to the DC component).

Although not shown, the apparatus body 100A is provided with a door for replacing the drum cartridge so that a user can open the door and replace the drum cartridge 90. In addition, in the present embodiment, in order to prevent malfunction, the user can replace the drum cartridge 90 when the power of the image forming apparatus 100 is turned off. The control unit 50 prevents the image forming apparatus 100 from operating in a case where the door for replacing the drum cartridge is not closed.

The memory tag 91 is provided exchangeably at the same time as the photosensitive drum 11. In the case of the present embodiment, the memory tag 91 is provided on the drum cartridge 90. In a case where the drum cartridge 90 is mounted to the apparatus body 100A of the image forming apparatus 100, the control unit 50 is connected with the memory tag 91 to be able to read data in the memory tag 91 through an input/output interface (not shown). The memory tag 91 is, for example, a non-volatile memory. In the memory tag 91 as an information storage portion, "inclination of surface potential" is held in advance as information (data) on the photosensitive member. The "inclination of surface potential" is data representing the amount of change in the surface potential of the photosensitive drum 11 with respect to the DC voltage applied to the charging roller 12 when a DC voltage equal to or higher than the discharge start voltage is applied to the charging roller 12, which was measured when manufacturing the drum cartridge 90. The amount of change is corresponding to a relationship of a DC applying voltage and the surface potential of the photosensitive drum 12. That is, the memory tag 91 stores the information with respect to the attenuation amount of the surface potential of the photosensitive drum 11 by which the surface potential is attenuating until the photosensitive drum 11 rotates from the contact position of the photosensitive drum 11 to the charging roller 12 to a development position of the photosensitive drum 11 facing to the developing sleeve 19. The control unit 50 can read out the "inclination of surface potential" specific to each of the photosensitive drums 11 from the memory tag 91 and write the "inclination of surface potential" in the memory 510.

Figure 4:
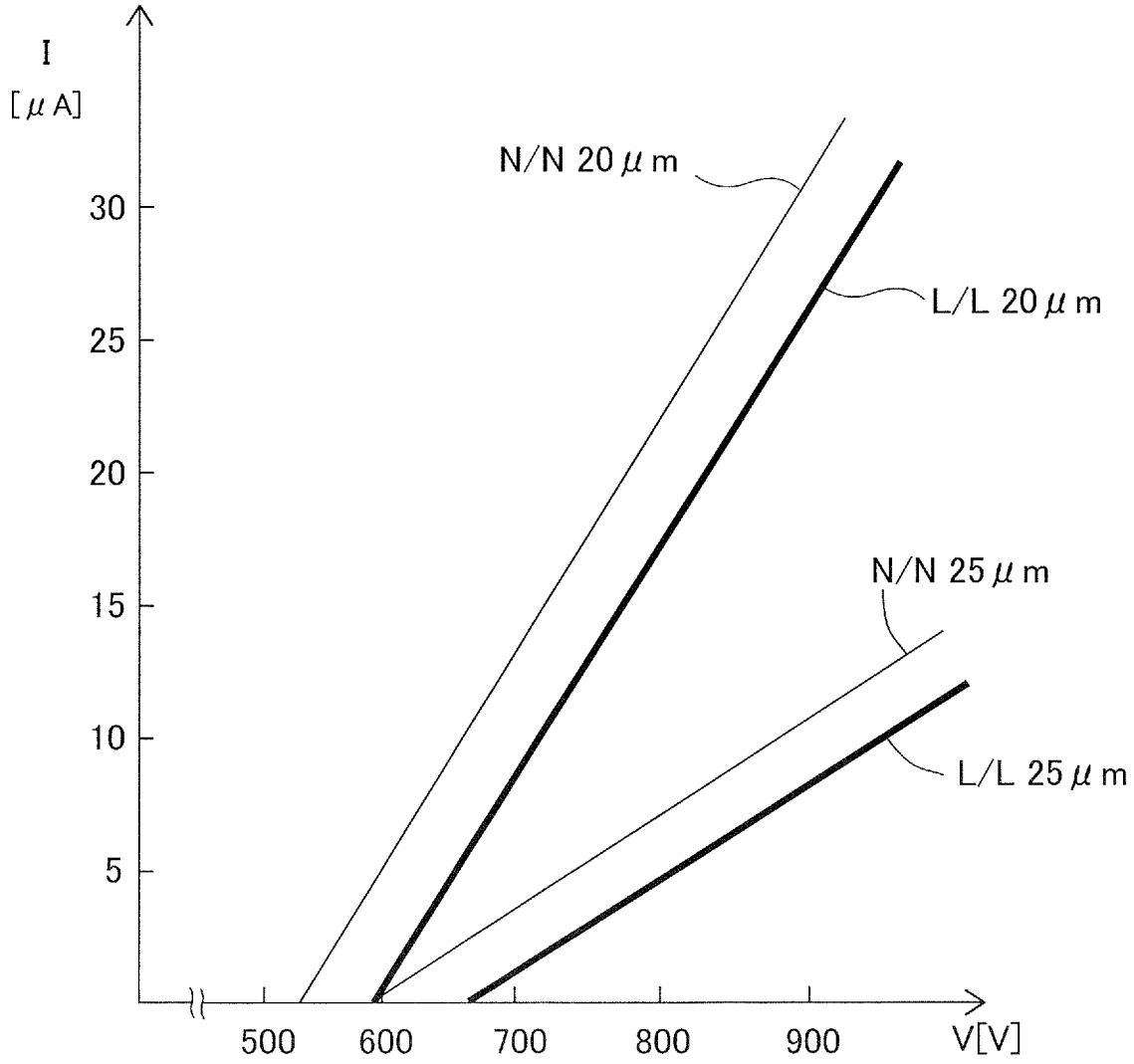
FIG. 4 is a graph showing a relationship between an applying voltage and a current according to temperature, humidity, and thickness of a charge transport layer of the photosensitive drum.
Figure 5:
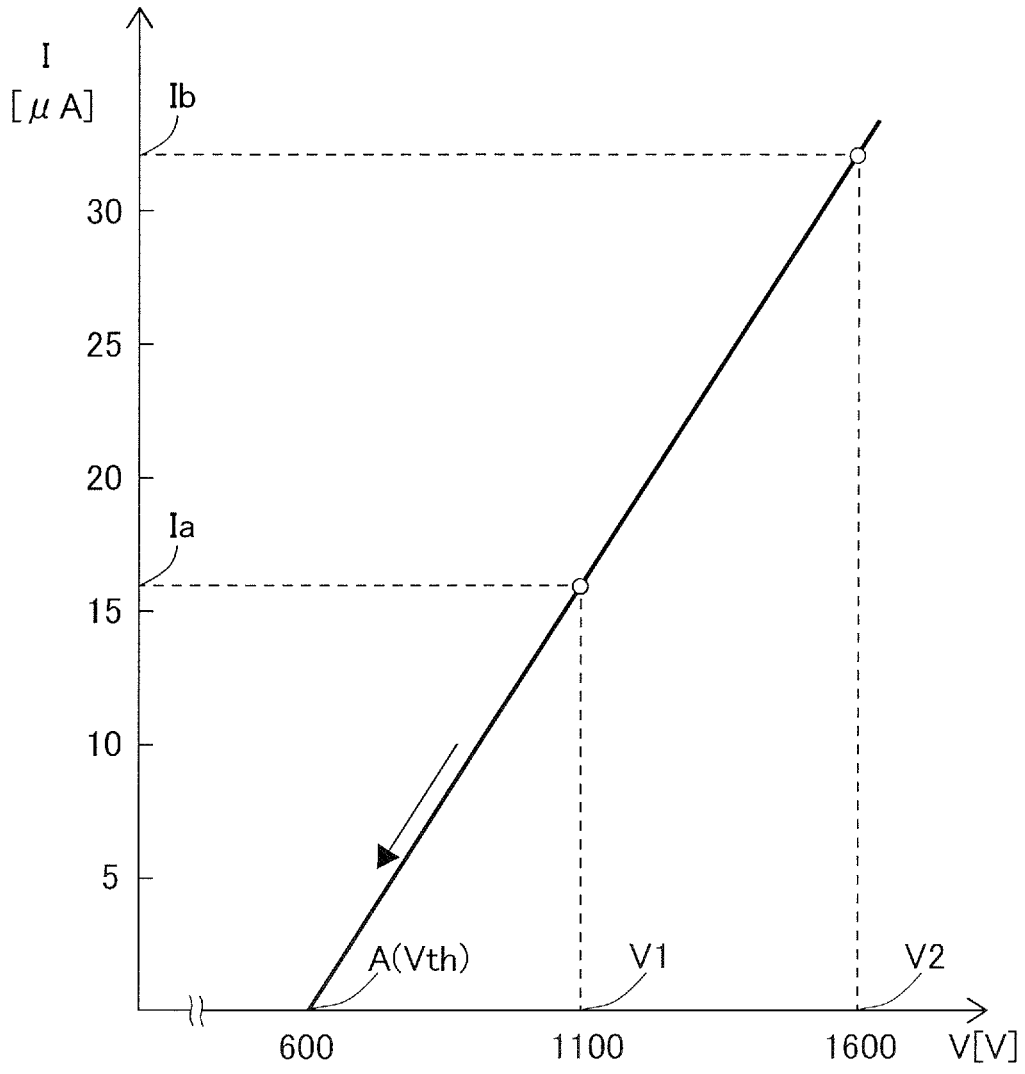
FIG. 5 is a graph showing a relationship between a voltage applied to a charging roller and a current flowing through the charging roller.

Next, the "discharge start voltage" will be described. FIG. 4 is a graph showing the relationship between the voltage (V) applied to the charging roller 12 and the current (μA) flowing to the photosensitive drum 11 through the charging roller 12 at that time. FIG. 5 is a graph showing the calculation of the discharge start voltage by the control unit 50.

In a case where a DC voltage is applied to the charging roller 12, the charging of the photosensitive drum 11 is started if the applying voltage is equal to or higher than a discharge start voltage Vth. The discharge start voltage Vth is a constant value, for example, without consideration of the installation environment (temperature, humidity, and the like), the deterioration (for example, the charge transport layer 55 being scraped due to durability, and the like) of the photosensitive drum 11, the variation of the impedance of the charging roller 12 and the photosensitive drum 11, and the like. In this case, the control unit 50 may set a voltage obtained by adding a target potential Vd_target (for example, 700 V) for charging the photosensitive drum 11 to the discharge start voltage Vth as the applying voltage Vc (Vc=Vth+Vd_target) of the charging roller 12.

However, for example, in a case where the installation environment changes or the charge transport layer 55 (CT layer) of the photosensitive drum 11 is scraped, as shown in FIG. 4 and Table 1 below, the discharge start voltage Vth may change. Table 1 shows data obtained by experimentally determining each discharge start voltage Vth in the normal temperature and normal humidity environment (N/N environment: for example, 23° C., 50% RH) and the low temperature and low humidity environment (L/L environment: for example, 15° C., 10% RH) in a case where the film thickness of the charge transport layer 55 is thickness in the initial state and thickness after durability, respectively.

TABLE 1

| | CT FILM THICKNESS | | | |
|---|---|---|---|---|
| | INITIAL 25 μm | | AFTER DURABILITY 20 μm | |
| ENVIRONMENT | L/L | N/N | L/L | N/N |
| Vth | 660 V | 600 V | 600 V | 540 V |

As shown in Table 1, the difference between the discharge start voltage Vth (540 V) after durability in the N/N environment and the discharge start voltage Vth (660 V) in the initial state in the L/L environment is as large as 120 V. Therefore, when the control unit 50 sets the discharge start voltage Vth to the initial state of the N/N environment (Vth=600 V) in a case where the control unit 50 is in the L/L environment, the surface potential Vd of the photosensitive drum 11 (the surface potential at the development position b, hereinafter the same) becomes significantly high, and the image density may be low.

In order to prevent this, the control unit 50 calculates the discharge start voltage Vth with the applying voltage applied to the charging roller 12 and the current (called charging current) flowing to the photosensitive drum 11 through the charging roller 12 at that time. Specifically, the control unit 50 first lowers the surface potential of the photosensitive drum 11 on the upstream side of the "contact position a" in the rotational direction to a predetermined potential (for example, 100 V) by the neutralizing and exposing unit 18 (see FIG. 1). This is because if the surface potential of the photosensitive drum 11 fluctuates from the predetermined potential before charging, it is difficult to specify the relationship between the applying voltage and the charging current when a voltage is applied to the charging roller 12.

After the surface potential of the photosensitive drum 11 is lowered to 100 V before charging, as shown in FIG. 5, two voltages V1 and V2 higher than the discharge start voltage Vth (point A in FIG. 5) are applied to the charging roller 12, and currents Ia and Ib flowing at that time are measured by the ammeter 80 (see FIG. 3). The relationship between the voltages V1 and V2 and the currents Ia and Ib is expressed by Formula 1 shown below.

$$I-Ia=\{(Ib-Ia)/(V1/V2)\}\times(V-V1) \quad \text{Formula 1}$$

In the above Formula 1, "V" in Formula 1 when "I=0" corresponds to the discharge start voltage Vth. As described above, the control unit 50 can measure the applying voltage applied to the charging roller 12 and the current flowing at that time and use the voltage and current to calculate the discharge start voltage Vth. In this case, since the image forming apparatus 100 does not have to be provided with a potential measuring device for measuring the surface potential of the photosensitive drum 11, the number of parts can be reduced and the apparatus can be downsized.

Figure 6:
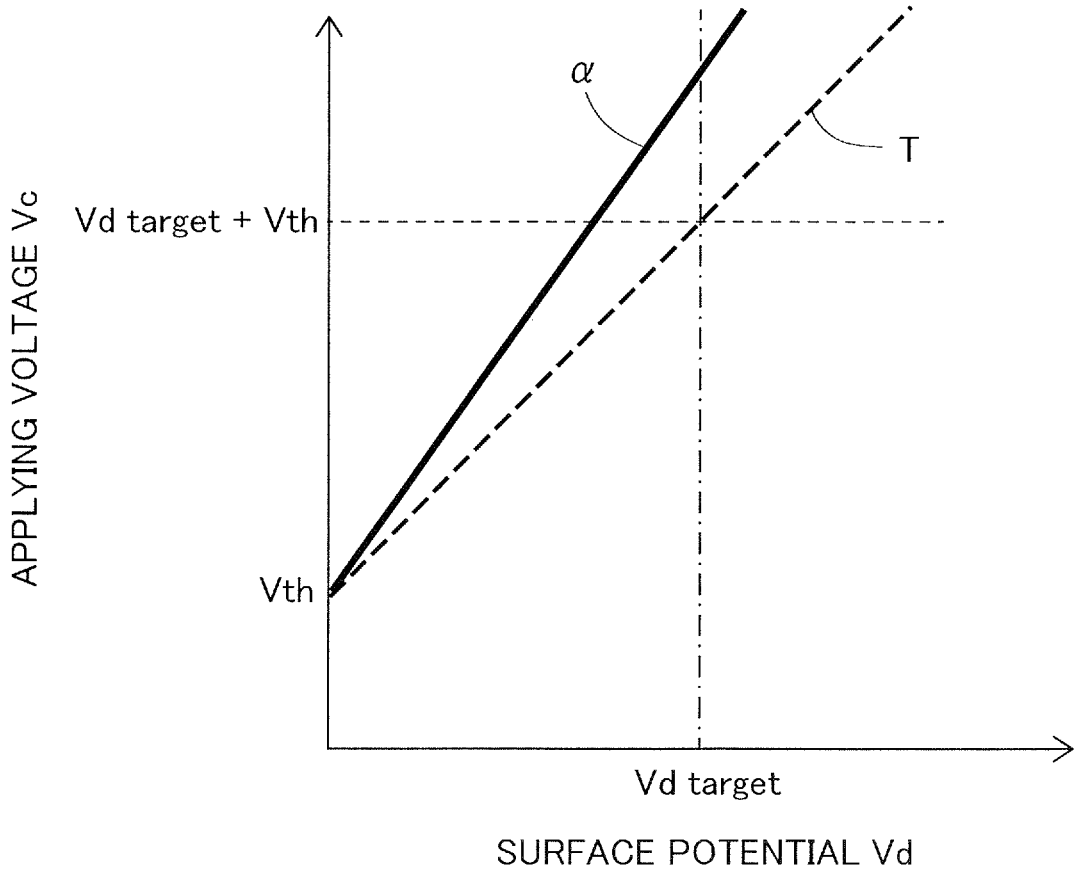
FIG. 6 is a graph showing a relationship of a surface potential of the photosensitive drum and the applying voltage in accordance with a variation in a dark attenuation amount of the photosensitive drum.

Next, "inclination of surface potential" will be described. In the case of the present embodiment, the control unit 50 sets the applying voltage Vc to be applied to the charging roller 12 by using the "inclination of surface potential" stored in advance in the memory tag 91 and the "discharge start voltage Vth" described above. FIG. 6 shows a graph in which the horizontal axis represents the surface potential Vd of the photosensitive drum 11 and the vertical axis represents the applying voltage Vc of the charging roller 12 and shows the relationship between the experimentally obtained surface potential Vd and the applying voltage Vc.

If a DC voltage is applied to the charging roller 12 and dark attenuation from the contact position a to the development position b of the photosensitive drum 11 (see FIG. 1) is not taken into consideration, the surface potential Vd of the photosensitive drum 11 increases at the same rate (inclination T=1 in FIG. 6) as the increase of the applying voltage Vc from the discharge start voltage Vth. In this case, the control unit 50 may set a voltage obtained by adding the target potential Vd_target (for example, 700 V) to the discharge start voltage Vth as the applying voltage Vc (Vc=Vth+Vd_target).

However, in a case of using the photosensitive drum 11 whose dark attenuation amount is 30 V or more, even in a case of the new photosensitive drum 11, the dark attenuation amount is likely to greatly vary, and due to the variation in the dark attenuation amount, the "inclination of surface potential" is not always "inclination T=1". In the case of the present embodiment, for example, in a case where the dark attenuation amount is a first attenuation amount, the "inclination of surface potential" becomes "inclination T (for example 1)", and in a case where the dark attenuation amount is a second attenuation amount larger than the first attenuation amount, the "inclination of surface potential" becomes "inclination α (for example, 1.061)". If the "inclination of surface potential" is different for each photosensitive drum 11, even if the discharge start voltage Vth is appropriate, as a result, the applying voltage Vc of the charging roller 12 is set lower than the voltage required to obtain a desired potential at the development position b, and an image defect may occur. In view of this point, in the present embodiment, the control unit 50 can set the applying voltage Vc of the charging roller 12 with the following Formula 2 using the "inclination of surface potential" of the photosensitive drum 11 stored in advance in the memory tag 91. In a case where the dark attenuation amount is the second attenuation amount larger than the first attenuation amount, a voltage obtained by adding a second change amount (see FIG. 6) larger than the first change amount of the surface potential Vd with respect to the applying voltage when the dark attenuation amount is the first attenuation amount, to the discharge start voltage is set as an applying voltage.

$$Vc=Vth+Vd_\text{target}\times\alpha \qquad \text{Formula 2}$$

Inclination Storage Processing

Next, a procedure for detecting the above-described "inclination of surface potential" for each photosensitive drum 11 and storing the "inclination of surface potential" in the memory tag 91 will be described. In order to detect the "inclination of surface potential", the drum cartridge 90 and a detection device (not shown) are prepared. The detection device is capable of detecting the "inclination of the surface potential" of the photosensitive drum 11 by applying a voltage to the photosensitive drum 11 and the charging roller 12 in the drum cartridge 90. As a detection device, for example, one provided with a driving unit capable of driving the photosensitive drum 11, a voltage application unit capable of applying a DC voltage to the charging roller 12, a potential measurement unit capable of measuring the surface potential (Vd) of the photosensitive drum 11 at the development position b (see FIG. 1), and a neutralization unit was used. The neutralization unit is, for example, an AC voltage power source, a neutralization member, and the like and is disposed on the downstream side of the development position b in the rotational direction of the photosensitive drum 11 and on the upstream side of the contact position a in the rotational direction to neutralize the surface of the photosensitive drum 11. The detection device is not limited to the above-described configuration. For example, an image forming apparatus modified for detection may be used.

Figure 7:
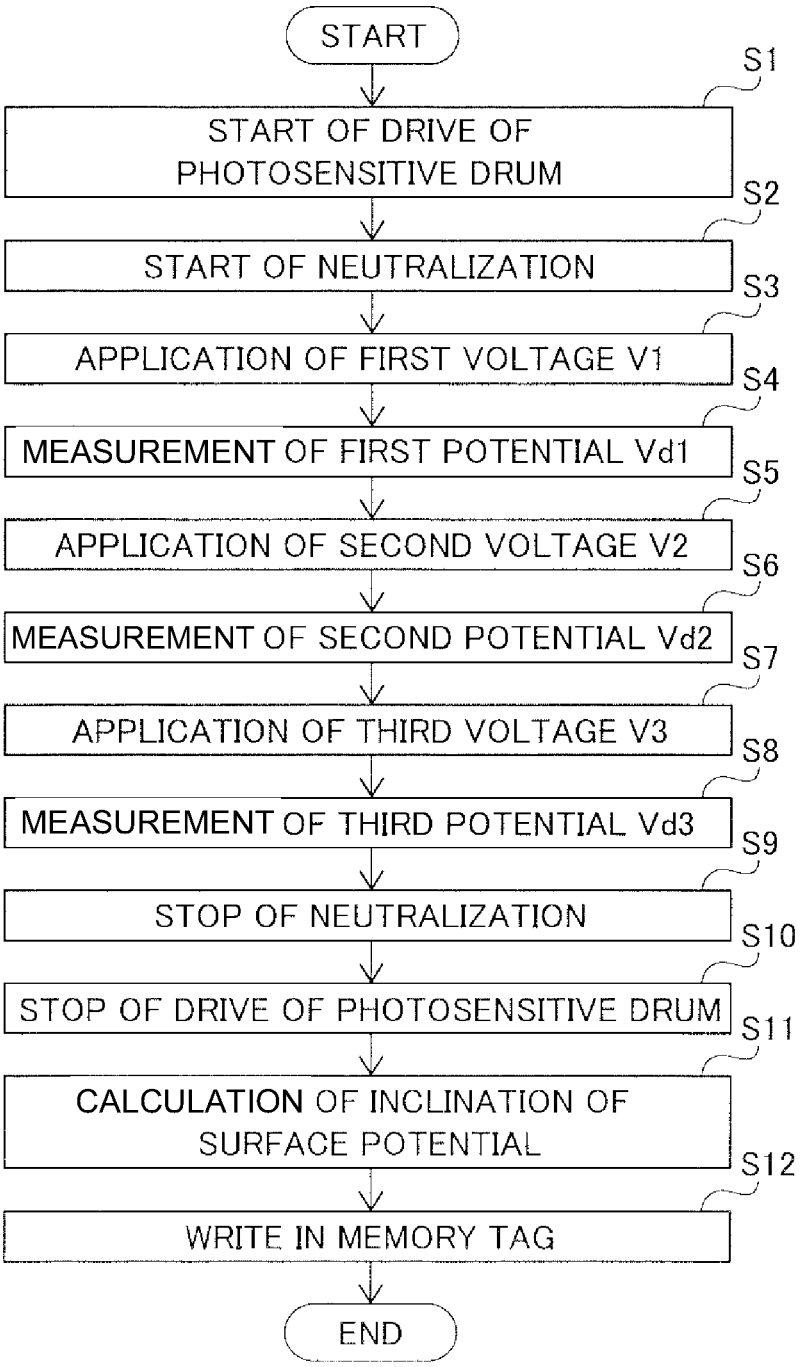
FIG. 7 is a flowchart showing inclination storage processing of measuring an inclination of the surface potential of the photosensitive drum and storing the inclination in a memory tag.
Figure 8:
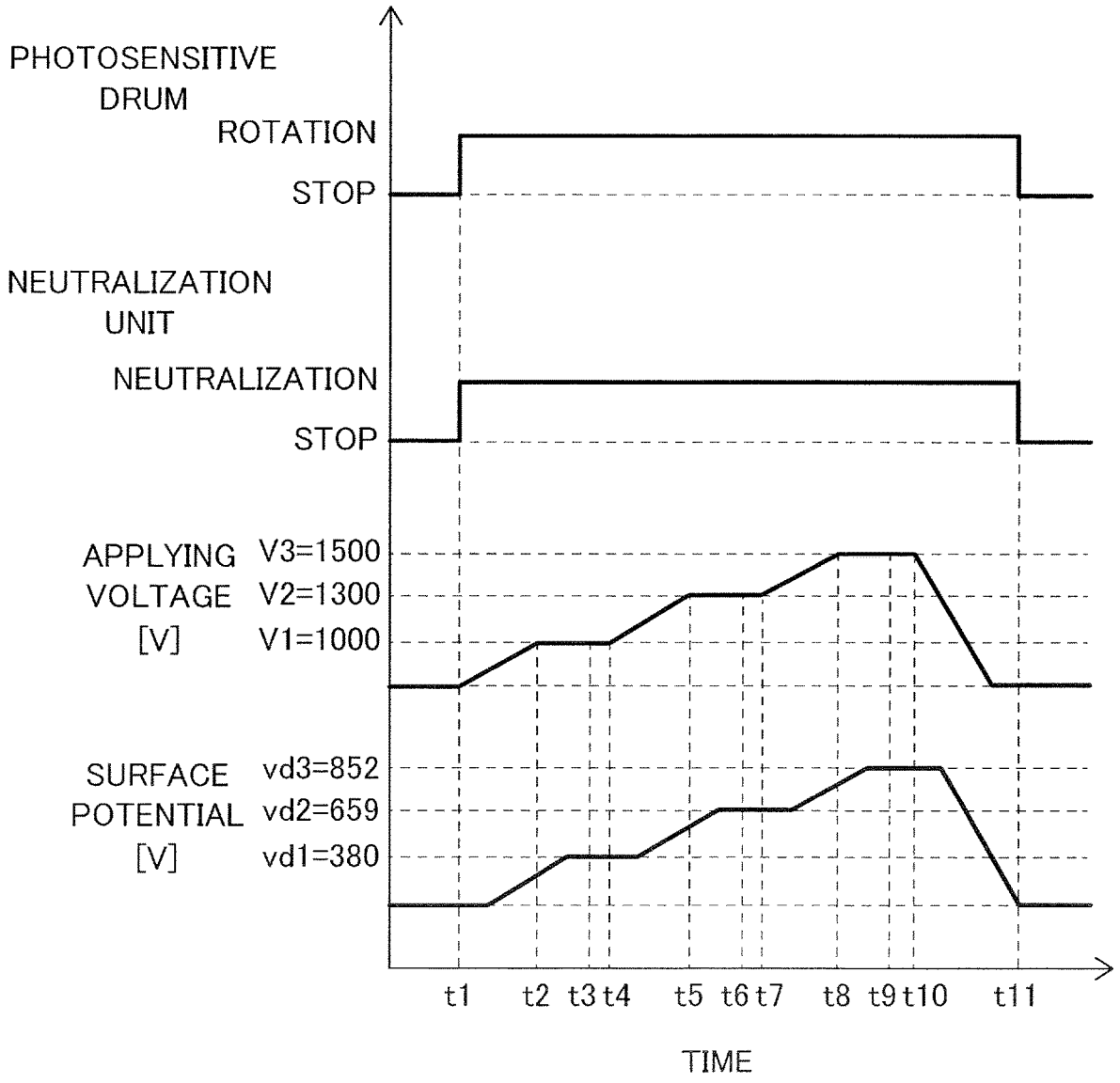
FIG. 8 is a timing chart at the time of inclination storage processing.

FIG. 7 shows "inclination storage processing" of measuring the "inclination of surface potential" of the photosensitive drum 11 and writing "inclination of surface potential" to the memory tag 91. In addition, FIG. 8 shows a timing chart at the "inclination storage processing". The "inclination storage processing" shown in FIG. 7 is processing performed by the above-described detection device to which the drum cartridge 90 having the photosensitive drum 11 to be detected is installed and is performed when the drum cartridge 90 is manufactured.

When the drum cartridge 90 is installed, driving of the photosensitive drum 11 is started by a driving unit (S1, t1). Then, with the start of the rotation of the photosensitive drum 11, the neutralization unit starts the neutralization of the photosensitive drum 11 (S2, t1). In the state where the rotation of the photosensitive drum 11 is stabilized, the voltage application unit applies a first voltage V1 (for example, 1000 V) to the charging roller 12 (S3, t2 to t4). In response to the application of the first voltage V1, the surface potential (a first potential Vd1) at the development position b of the photosensitive drum 11 is measured by the potential measurement unit (S4, t3). The measurement result is, for example, 380V. The measurement of the first potential Vd1 by the potential measurement unit, and a second potential Vd2 and a third potential Vd3 to be described later is preferably performed over at least one rotation of the photosensitive drum 11 in order to remove the potential fluctuation of the photosensitive drum 11 and the charging roller 12 in the circumferential direction.

After the measurement of the first potential Vd1, the voltage application unit applies a second voltage V2 (for example, 1300 V) to the charging roller 12 (S5, t5 to t7). In response to the application of the second voltage V2, the surface potential (second potential Vd2) at the development position b of the photosensitive drum 11 is measured by the potential measurement unit (S6, t6). The measurement result is, for example, 659V.

After the measurement of the second potential Vd2, a third voltage V3 (for example, 1500 V) is further applied to the charging roller 12 by the voltage application unit (S7, t8 to t10). In response to the application of the third voltage V3, the surface potential (third potential Vd3) at the development position b of the photosensitive drum 11 is measured by the potential measurement unit (S8, t9). The measurement result is, for example, 852 V.

After the surface potentials are measured three times as described above, the neutralization by the neutralization unit is stopped (S9, t11), and the drive of the photosensitive drum 11 by the driving unit is stopped (S10, t11). Then, based on the above first to third voltages (V1 to V3) and the first to third potentials (Vd1 to Vd3), the "inclination of surface potential" of the photosensitive drum 11 is calculated (step S11). The "inclination of surface potential" is calculated by the following Formula 3.

$$\alpha = \frac{3\sum Vd * V - (\sum Vd)(\sum V)}{3\sum Vd^2 - (\sum Vd)^2} \quad \text{Formula 3}$$

The "inclination of surface potential" calculated in this manner is, for example, "1.061". Then, the calculated "inclination of surface potential" is written and stored in the memory tag 91 provided on the drum cartridge 90 (S12). Thus, the drum cartridge 90 in which the "inclination of surface potential" is stored in the memory tag 91 is packaged and shipped as a product.

Processing Upon Replacement

Next, "drum replacement processing" executed in a case where a new drum cartridge 90 is installed in the image forming apparatus 100 will be described by using FIG. 9 with reference to FIG. 3. The "drum replacement processing" in the present embodiment is executed by the control unit 50 (see FIG. 3). When the power is turned on after the user installs a new drum cartridge 90 in the image forming apparatus 100, the control unit 50 executes the "drum replacement processing" shown in FIG. 9.

Figure 9:
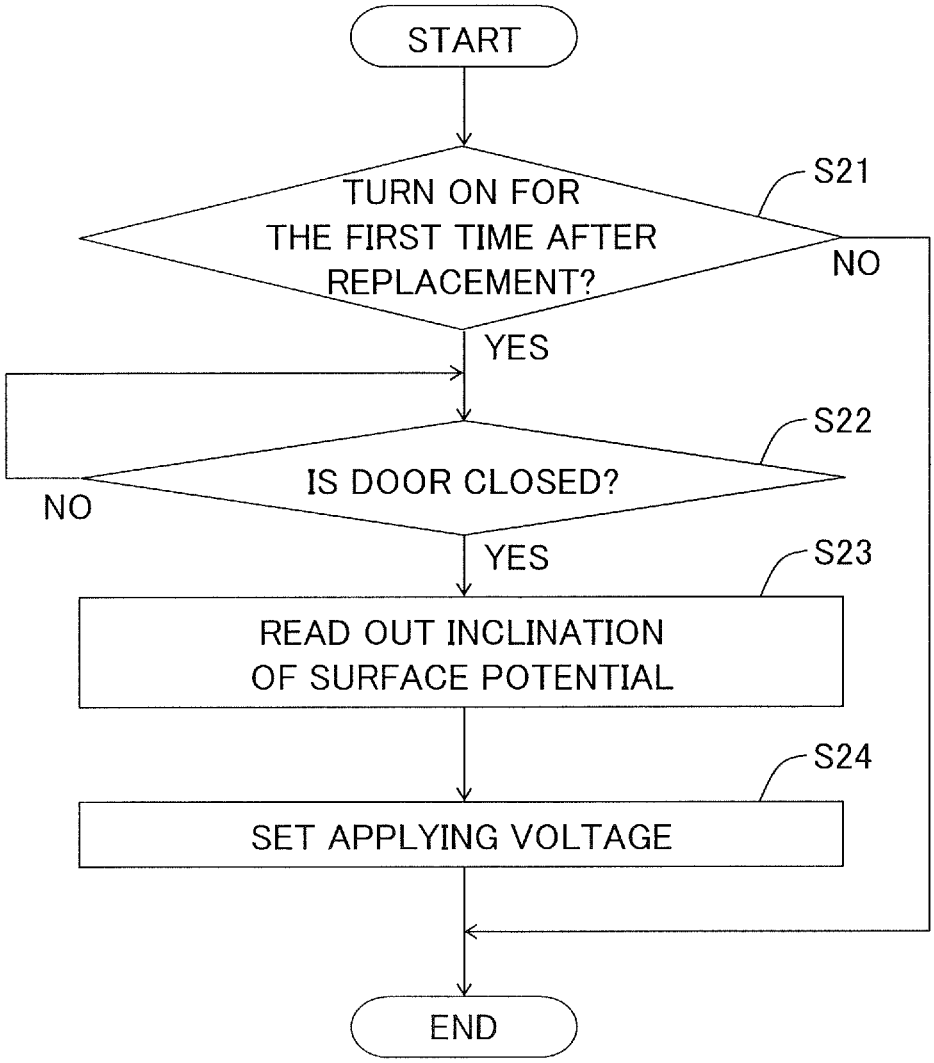
FIG. 9 is a flowchart showing processing upon replacement of the photosensitive drum.

As shown in FIG. 9, the control unit 50 determines whether or not the power of the apparatus body is turned on for the first time after the drum cartridge 90 has been replaced (S21). In a case where the power of the apparatus body is not turned on for the first time after the drum cartridge 90 is replaced (NO in S21), the control unit 50 ends the drum replacement processing. On the other hand, in a case where the power of the apparatus body is turned on for the first time after the drum cartridge 90 is replaced (YES in S21), the control unit 50 determines whether or not the door for replacing the drum cartridge (not shown) is closed (S22). Whether or not the door for replacing the drum cartridge is closed may be detected by a door opening and closing sensor (for example, an optical sensor or the like). In a case where the door for replacing the drum cartridge is open (NO in S22), the control unit 50 waits for processing until the door for replacing the drum cartridge is closed. In a case where the door for replacing the drum cartridge is closed (YES in S22), assuming that image formation is possible, the control unit 50 reads out the "inclination of surface potential" from the memory tag 91 of the mounted drum cartridge 90 and writes the "inclination of surface potential" in the memory 510 (S23).

Then, the control unit 50 sets the applying voltage Vc to be applied to the charging roller 12 by using the "inclination of surface potential" written in the memory 510 (S24). That is, the control unit 50 calculates the discharge start voltage Vth in accordance with the above Formula 1 and sets the applying voltage Vc in accordance with the above Formula 2 from the discharge start voltage Vth and the "inclination of surface potential".

Next, an experiment was performed to compare the present embodiment with a hitherto example regarding the setting of the applying voltage Vc. The environment was an N/N environment, and the charge transport layer 55 of the photosensitive drum 11 was scraped to approximately 20 μm by passing a large number of recording media. Then, the photosensitive drum 11 was rotated at a rotational speed of approximately 300 mm/s.

The surface potential of the photosensitive drum 11 whose surface has been cleaned by a cleaning blade 20 is set to approximately 100 V by the neutralizing and exposing unit 18. Next, in order to calculate the discharge start voltage, the voltage V1 of approximately 800 V and the voltage V2 of approximately 1400 V were applied to the charging power source 70, and the currents Ia and Ib flowing according to the voltages V1 and V2 were measured. Here, it is assumed that the current Ia of 20 μA flows when the voltage V1 of approximately 800 V is applied, and the current Ib of 80 μA flows when the voltage V2 of approximately 1400 V is applied. By using the voltages V1 and V2 and the currents Ia and Ib, the calculation according to the above Formula 1 is performed to calculate the discharge start voltage Vth "540 V".

In the case of the example of the related art hitherto, in a case where the dark attenuation amount is the first attenuation amount (for example, 10 V) and in a case where the dark attenuation amount is the second attenuation amount (for example, 50 V) larger than the first attenuation amount, the applying voltage Vc is set by the same "inclination of surface potential" (inclination T (=1) in FIG. 6). Specifically, "1240 V" obtained by adding a value "700 V" obtained by multiplying the target potential (700 V) by the "inclination T" to the discharge start voltage Vth "540 V" is set as the applying voltage Vc. In a case where the dark attenuation amount is the first attenuation amount, when image formation was performed by applying the applying voltage Vc "1240 V" to the charging roller 12, the surface potential Vd of the photosensitive drum 11 was approximately 690 V, which was a value close to the target potential "700 V". Therefore, it was possible to obtain a good image. On the other hand, in a case where the dark attenuation amount was the second attenuation amount, when image formation was performed by applying the applying voltage Vc "1240 V" to the charging roller 12, the surface potential Vd of the photosensitive drum 11 became approximately 650 V, and a value close to the target potential "700 V" was not obtained, and an image defect occurred.

On the other hand, in the present embodiment, no image defect occurred in a case where the dark attenuation amount is the first attenuation amount (for example, 10 V) and in a case where the dark attenuation amount is the second attenuation amount (for example, 50 V) larger than the first attenuation amount. In a case where the "inclination of surface potential" is "inclination T" in FIG. 6 when the dark attenuation amount is the first attenuation amount, the applying voltage Vc is set to "1240 V" (a first voltage) obtained by adding "700 V" (the first change amount) obtained by multiplying the target potential by the "inclination T" to the discharge start voltage Vth "540 V". When image formation was performed by applying the applying voltage Vc "1240 V" to the charging roller 12, the surface potential Vd of the photosensitive drum 11 was approximately 690 V, and since a value close to the target potential "700 V" was obtained, no image defect occurred.

On the other hand, in a case where the "inclination of surface potential" is the inclination α (=1.061) shown in FIG. 6 when the dark attenuation amount is the second attenuation amount larger than the first attenuation amount, the value obtained by multiplying the target potential by the inclination α is "743 V" (the second change amount). The applying voltage Vc "1283 V" (a second voltage) is set by adding the second change amount "743 V" having a larger change amount than the first change amount to the discharge start voltage Vth "540 V". When image formation was performed by applying the applying voltage Vc "1283 V" to the charging roller 12, the surface potential of the photosensitive drum 11 was approximately 695 V, and since a value close to the target potential "700 V" was obtained, no image defect occurred.

As described above, in the present embodiment, the applying voltage Vc to be applied to the charging roller 12 to charge the photosensitive drum 11 can be set by using the "inclination of surface potential" previously stored in the memory tag 91, for each individual photosensitive drum 11 where the dark attenuation amount may differ. By setting the applying voltage Vc using an "inclination of surface potential" specific to each photosensitive drum 11, the applying voltage Vc corresponding to the variation in the dark attenuation amount of each photosensitive drum 11 may be applied to the charging roller 12. Then, even if the photosensitive drum 11 is replaced, because the surface potential Vd of the photosensitive drum 11 is accurately maintained at an appropriate potential (target potential) before and after replacement, it is possible to suppress the occurrence of image defects.

Other Embodiments

In the above-described embodiment, a case where the applying voltage Vc is set by using the "inclination of surface potential" when a new drum cartridge 90 is installed in the image forming apparatus 100 is described as an example, but the present invention is not limited thereto. For example, at the time of non-image formation, the control unit 50 may execute a setting mode in which the applying voltage Vc is set by using the "inclination of surface potential". That is, a plurality of different DC voltages are applied to the charging roller 12, the current flowing at that time is acquired by the ammeter 80, the discharge start voltage Vth is determined, and processing of setting the applying voltage Vc can be performed based on the determined discharge start voltage Vth and the "inclination of surface potential". In this case, it is possible to apply an applying voltage, corresponding to the change of the discharge start voltage Vth due to the deterioration of the photosensitive drum 11 due to the durability (time) and the environmental conditions and corresponding to the variation in the dark attenuation amount of each photosensitive drum 11 and the like, to the charging roller 12.

In the present specification, the time of non-image formation refers to, for example, the time of pre-rotation, the time of post-rotation, sheet interval, and the like. The time of pre-rotation is a period from the start of rotation of the photosensitive drum 11 and the like after receiving a print signal at the start of image formation without forming a toner image to the start of exposure on the photosensitive drum 11. The time of post-rotation is a period from the end of the last image formation of the image forming job to the stop of the rotation of the photosensitive drum 11 and the like which is continuously rotated without forming a toner image. The sheet interval is a period between an image area and the image area corresponding to the recording material S. In the case where various controls are performed during the sheet interval, the sheet interval may be extended appropriately.

In the above-described embodiment, the image forming apparatus has been described in which the toner images of the respective colors are primarily transferred from the photosensitive drums 11Y to 11K of the respective colors to the intermediate transfer belt 16 and then the composite toner images of the respective colors are secondarily transferred onto the recording material S at once, but the present invention is not limited thereto. For example, the image forming apparatus may be a direct transfer type in which images are directly transferred from the photosensitive drums 11Y to 11K to the recording material S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-137198, filed Jul. 20, 2018, which is hereby incorporated by reference herein in its entirety.

What is claimed is:

1. An image forming apparatus comprising:

a photosensitive member unit comprising a rotatable photosensitive member and being attachable to or detachable from the image forming apparatus;

a charging roller configured to contact the photosensitive member and charge a surface of the photosensitive member by applying only a DC voltage;

an exposing unit configured to expose the charged surface of the photosensitive member to form an electrostatic latent image;

a developing unit comprising a developer bearing member for bearing developer and configured to develop the electrostatic latent image formed on the photosensitive member;

a current detection unit configured to detect a current flowing to the charging roller;

an information storage portion provided in the photosensitive member unit and configured to store a change rate of a surface potential of the photosensitive member with respect to a voltage to be applied to the charging roller, the change rate being set on the basis of an attenuation amount of the surface potential of the photosensitive member by which the surface potential attenuates as the photosensitive member rotates from a contact position of the photosensitive member to the charging roller to a development position of the photosensitive member facing the developer bearing member; and a control portion configured to set the voltage to be applied to the charging roller at a time of image formation on the basis of a charge start voltage and the change rate stored in the information storage portion, the charge start voltage being obtained based on a plurality of different voltage values and a plurality of current values detected by the current detection unit when a plurality of voltages having the plurality of different voltage values are applied to the charging roller.

* * * * *